US005195837A

United States Patent [19]

Steppe et al.

[11] Patent Number: 5,195,837

[45] Date of Patent: Mar. 23, 1993

[54] COOLING DEVICE FOR AN ELECTRIC PRINTER, PARTICULARLY MATRIX PRINTER

[75] Inventors: Erich Steppe; Manfred Gruener, both of Ulm, Fed. Rep. of Germany

[73] Assignee: Mannesmann AG, Düsseldorf, Fed. Rep. of Germany

[21] Appl. No.: 870,093

[22] Filed: Apr. 16, 1992

Related U.S. Application Data

[63] Continuation-in-part of Ser. No. 412,643, Sep. 25, 1989, abandoned, which is a continuation of Ser. No. 753,656, Jul. 10, 1985, abandoned.

[30] Foreign Application Priority Data

Jul. 11, 1984 [DE] Fed. Rep. of Germany ..... 3425469

[51] Int. Cl.[5] ..... B41J 29/377

[52] U.S. Cl. ..... 400/719; 400/124

[58] Field of Search ..... 400/124 TC, 691, 693, 400/719; 174/16.3; 312/236

[56] References Cited

U.S. PATENT DOCUMENTS

| | | | |
|---|---|---|---|
| 3,202,869 | 8/1965 | Matson et al. | 174/16 HS X |
| 3,599,313 | 8/1971 | Litvin | 400/694 |
| 3,883,834 | 5/1975 | Osteen | 174/16 HS X |
| 4,060,847 | 11/1977 | Penrod | 174/16 HS X |
| 4,408,220 | 10/1983 | Calabro | 174/16 HS X |
| 4,415,025 | 11/1983 | Horvath | 174/16 HS X |
| 4,493,573 | 1/1985 | Hashimoto et al. | 400/690.1 X |

OTHER PUBLICATIONS

IBM Technical Disclosure Bulletin, "Semiconductor Module With Improved Aircooling", by *Cain et al*, vol. 19, No. 5, Oct. 1976 p. 1802.

*Primary Examiner*—David A. Wiecking
*Attorney, Agent, or Firm*—R. H. Siegemund

[57] ABSTRACT

A matrix printer includes a plurality of components, an outer casing and a frame. A flexible ribbon is provided which connects a component with either the frame or casing in order to conduct heat awau from the component; the ribbon is compressed at its point of connection to establish a good heat conductive connection.

7 Claims, 2 Drawing Sheets

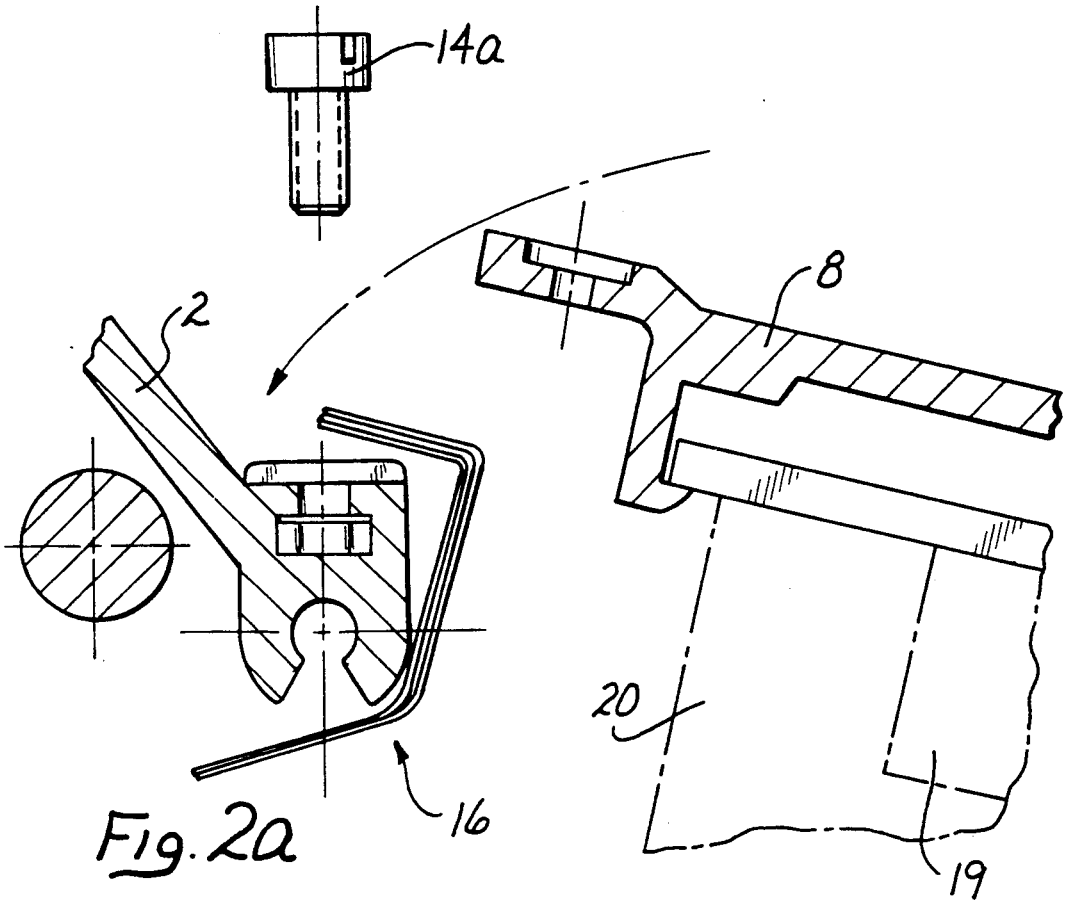
Fig. 2a
Fig. 2b
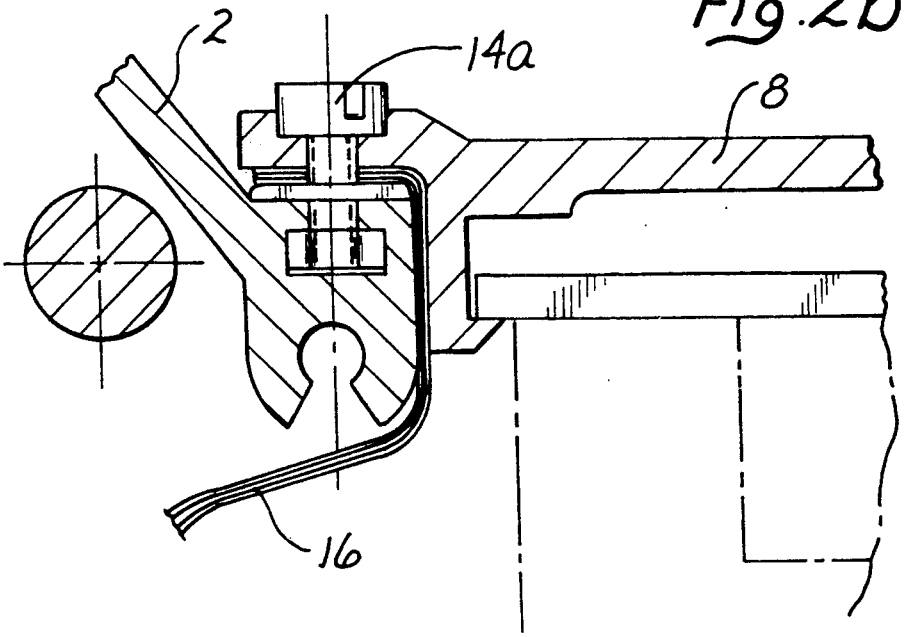

COOLING DEVICE FOR AN ELECTRIC PRINTER, PARTICULARLY MATRIX PRINTER

This is a continuation-in-part of co-pending application Ser. No. 07/412,643 filed on Sep. 25, 1989, now abandoned, which is a continuation of Ser. No. 06/753,656, filed Jul. 10, 1985, now abandoned.

BACKGROUND OF THE INVENTION

The present invention relates to cooling electrical printers particularly matrix printers wherein the electrical and electronic components are compactly arranged within a small space.

Cooling of equipment of the type to which the invention pertains is essentially a process for removing thermal energy produced by electric current. This thermal energy is a loss and is produced by and in electrical resistances. Unless the operation of the printer can be carried out at a fairly low temperature, long lasting operation and inadequate heat removal will cause the electrical and particularly the electronic components to become unduly heated and ultimately they will fail. Excessive heating is a cumulative process of deterioration towards failure.

Generally it is known in electronic equipment and in matrix printers in particular to provide forced cooling through a built-in fan. The various electrical components as well as mechanical mounting structure for these components, such as the matrix printhead, will be provided with heat dissipating surfaces such as cooling ribs which will be exposed to the air current from the fan so as to enhance the heat removal process. It is necessary to arrange the components to be cooled so that they are exposed to the air flow in the most favorable fashion. Here it has to be considered that the matrix printhead moves within the printer i.e. inherently changes its position vis-a-vis the fan. Generally speaking it was found that establishing adequate air flow conditions in such printers means that in most cases the volume and space requirement is increased.

It is well known that in electronics presently there is an increasing trend towards compactness in the arrangement of the electronic components which means higher power and power requirement for the same or smaller component size. In order to economize in the manufacturing functional groups which used to be arranged on different printed circuit boards will now be compactly constructed. This tendency leads inherently to a larger density in the development of thermal energy and compactness has often lead to situation that one or the other of the electronic parts are no longer adequately enveloped by the cooling airflow.

DESCRIPTION OF THE INVENTION

It is an object of the present invention to improve cooling conditions in printers and particularly in matrix printers having compactly arranged electronic and electric circuit elements.

It is another object of the present invention to provide cooling in printers such as matrix printers without utilization of a fan;

It is another particular object of the invention to construct the arrangement of electric and electronic components in printers such as matrix printers so that in addition to any fan cooling the cooling process is greatly enhanced whereby generally speaking failure of components because of undue heating is to be avoided.

In accordance with the preferred embodiment of the present invention it is suggested to heat-conductively connect an electric/electronic component in such a printer which may be unduly heated on account of current heat losses, to the frame, casing and/or housing of the printer under utilization of a flexible, possible elastic or resilient heat bridge. Such an elastic, flexible or resilient heat bridge has a considerable number of advantages. First of all the heat removal is carried out by means of heat conduction through solid material and not by heat transfer to a different medium. Through proper adjustment of the cross section of the heat bridge the total heat conduction of that bridge can readily be adjusted in accordance with the heat flow expected to be accommodated. Any manufacturing tolerances the heat bridge may have are compensated by the elasticity, flexibility or resiliency. Even though a connection is established between the electric or electronic components and the frame or the housing of the printer contact-voltages are avoided through the and any shocks or other impact forces will hardly be transmitted from the outside i.e. from the frame or the casing to the respective components on account of the attenuating effect such a flexible elastic or resilient heat bridge exhibits.

In furtherance of the invention it is suggested to establish the flexible, elastic or resilient heat bridge through an easily flexing metal strip having a large surface and interconnecting two connect points situated one above the other. Such a metal ribbon or strip extends the ground potential through very low resistance to currents at ground or near ground level within the entire arrangement, in addition to the removal of heat.

It was found advantageous to establish a heat bridge by means of several stacked ribbon-like foils that establish not only a certain elasticity and flexibility, but through the selection of an appropriate number of these foils one can readily adjust the effective cross section for heat conduction and one can readily enlarge the surface if needed. The foils each should have a thickness between 1/10 and 2/10 of a mm. This arrangement of a foil bundle sets the requisite flexibility at low weight and permits easy adjustment of cross section surface and overall heat conduction in fine steps. The foils are preferably made of aluminum which is a cost saving factor. Since the frame and/or the outer casing is likewise made of aluminum one can readily see that the heat flow is not impeded by any interface between two different types of metals.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 2*c* and FIG. 2*b* show details before and after making up the connection between frame, casing or housing and a flexible heat conductor.

Figure 1:
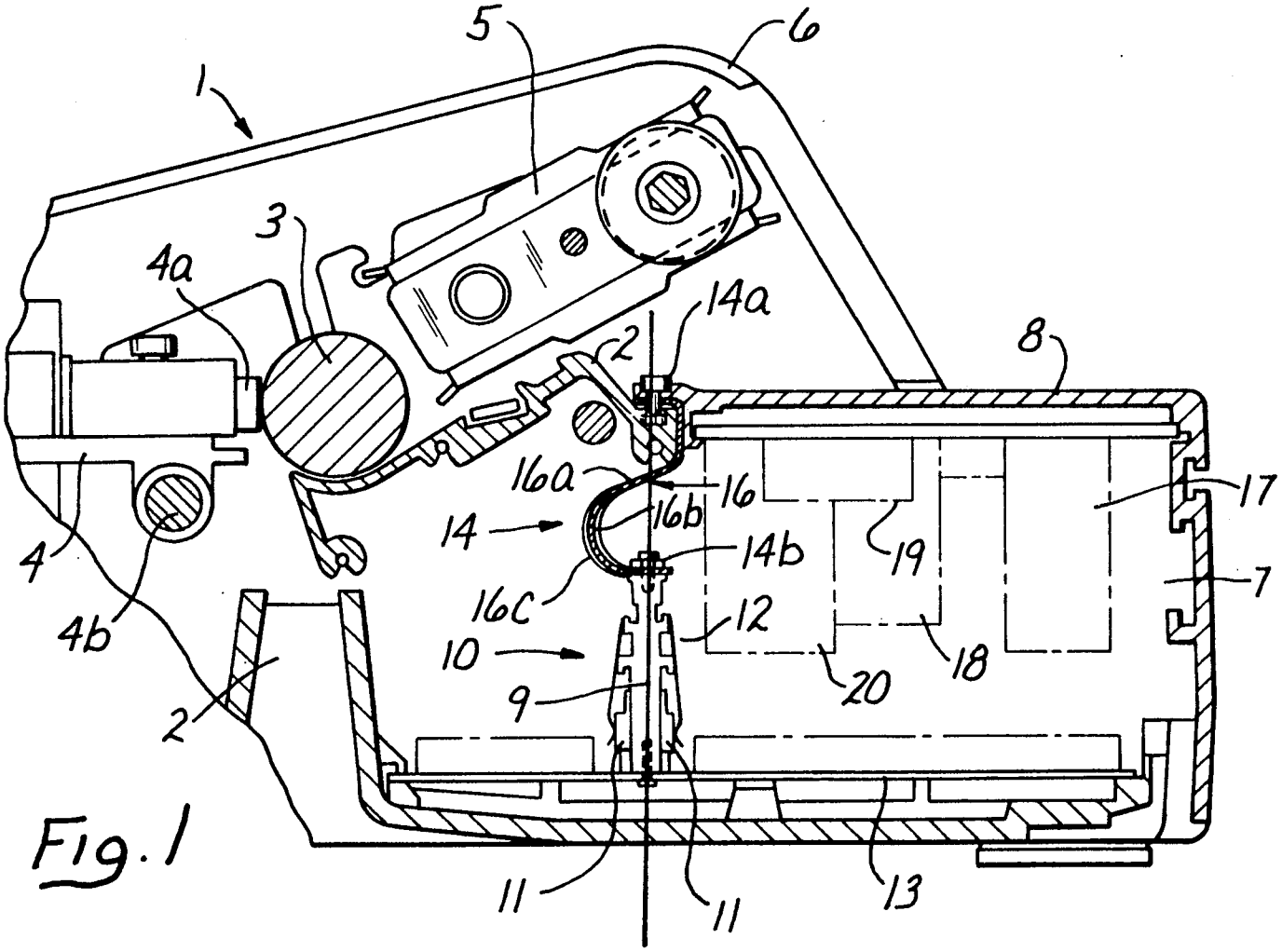
FIG. 1 illustrates a partial cross section through a matrix printer having an internal frame, various component groups and an outer casing or printer housing.

The matrix printer 1 has a frame 2 carrying the various component groups. There is the platen roller 3 and along that platen roller certain parts are arranged, such as a carriage 4 for the printhead 4*a* riding or sliding on a rod 4b which is suitably affixed to the housing of the printer. On the other side of the printhead arrangement there is a traction device 5 for transporting the print medium. These components are all covered by a transparent cover 6. The interior space 7 of the casing 8 accommodates printed circuit boards 9, possibly miniature boards which can be construed in addition to their support and mounting function to establish a heat conductive carrier for all the various electronic and electrical components 10 mounted thereon. Power transistors 11, diodes 12 and so forth being mounted on these miniature plates a and together establish a compact arrangement of electric/electronic components 10. The boards 9 in turn are mounted on a "back wiring" board 13 that establishes the interconnect circuit among the several boards 9 and the components thereon.

The printed circuit boards 9 are connected by means of a resilient heat bridge 14 with the frame 2. For this, frame 2 is provided with fasteners 14a, while analogously fasteners 14b are provided at the respective printed circuit board 9. The heat bridge 14 is established by means of a flexible metal ribbon 16 being bent preferably into an overall S configuration. The metal ribbon 16 is established through a plurality of stacked or juxtaposed strip like foils 16a, 16b, 16c, etc. The foils are between 1/10th and 2/10th of a millimeter thick and are made of aluminum. Additional heat resistance is avoided, if the frame 2 and/or the casing 8 is likewise made of aluminum for example by means of die casting, or injection molding.

FIG. 2a shows frame 2 and housing part 8 prior to being fastened by means of the screw 14a. FIG. 2b shows in greater detail that the end of multilayer ribbon 16 is sandwiched in between rims of parts 2 and 8 and thus makes good heat conductive contact with both of these parts so that both of them participate in the heat dissipation. The two fastening points 14a, *b* may be offcenter on account of the tolerances mentioned above, but the flexibility of the ribbon including twistability compensates the misalignment.

Heat developed by the electrical components on the printed circuit board 9 flows into a heat conductive portion of that plate 9, from there through the flexible heat bridge 14 and into the casing and frame 8 to be dissipated into the outer air by the large surface provided by these elements. Of course it is possible to connect various other electric and electronic components such as 17, 18, 19 and 20 likewise through flexible heat bridges 14 with a frame and/or the casing 8.

The invention is not limited to the embodiments described above, but all changes and modifications thereof, not constituting departures from the spirit and scope of the invention, are intended to be included.

We claim:

1. In a printer, such as a matrix printer, having compactly arranged electric and electronic components further having an outer casing and an internal metal frame, the improvement comprising:

a flexible metal ribbon established by a plurality of stacked foils to serve as a heat bridge, the metal ribbon being an easily flexing metal strip on account of the plurality of metal foils and having a relatively large surface;

means establishing two fastening points, arranged one above each other, the flexible metal ribbon being connected to said fastening points, one of which being provided for connecting the ribbon to the component, the other one being a connection that compresses the foils of the ribbon and forces end portions of them into good heat conductive contact with at least that one of the casing and the frame which is made of metal to thereby physically and heat conductively connect the component heat conductively to the casing or the frame.

2. The improvement as in claim 1, said foils having a thickness, between 1/10th and 2/10th of a millimeter.

3. The improvement as in claim 2, said foils being made of aluminum.

4. The improvement as in claim 3, said frame and or casing being made of aluminum.

5. The improvement as in claim 1, said heat bridge being made of the same material as the casing and/or frame.

6. The improvement as in claim 5, said material being aluminum.

7. In a printer, such as a matrix printer, having compactly arranged electric and electronic components further, having an outer casing and a frame, the improvement comprising:

a flexible metal ribbon established by a plurality of stacked foils to serve as a heat bridge;

means establishing a first fastening point, for connecting the ribbon to one of the components; and a fastener connection for connecting the ribbon to the casing and to the frame to thereby physically and heat conductively connect the component heat conductively to the casing and to the frame, in that the fastener connection connects one side of an end portion of the ribbon to the frame, the other side of that end portion of the ribbon to the casing while compressing the stacked foils of that end portion, between casting and frame for good heat conduction to both.

* * * * *